US005419018A

United States Patent [19]

Karlis et al.

[11] Patent Number: 5,419,018

[45] Date of Patent: May 30, 1995

[54] SHEET OF CLIPS

[75] Inventors: Robert G. Karlis, Hingham; Linda M. Gauger, Brookline; Richard J. Keohan, Braintree, all of Mass.

[73] Assignee: Clix Products, Inc., Mass.

[21] Appl. No.: 145,955

[22] Filed: Nov. 1, 1993

[51] Int. Cl.[6] ..... B42F 21/00; B65D 85/00

[52] U.S. Cl. ..... 24/67.9; 24/67 R; 24/547; 206/473

[58] Field of Search ..... 24/67.9, 67 R, 547; 206/473, 343, 345; 40/330; 312/183, 184

[56] References Cited

U.S. PATENT DOCUMENTS

| | | | |
|---|---|---|---|
| 364,623 | 6/1887 | Beidler | 206/473 |
| 649,338 | 5/1900 | McGill . | |
| 1,338,861 | 5/1920 | Frame . | |
| 1,757,964 | 5/1930 | Hurst . | |
| 1,854,149 | 4/1932 | Laencher . | |
| 1,878,861 | 9/1932 | Krasnov . | |
| 2,100,708 | 11/1937 | Blakley et al. | 24/261 |
| 2,116,147 | 5/1938 | Haessler | 116/119 |
| 2,159,322 | 5/1939 | Drummond | 40/330 |
| 3,057,028 | 10/1962 | Lorber | 24/66 |
| 3,137,934 | 6/1964 | Rhoads | 29/417 |
| 3,673,641 | 7/1972 | Lorber | 24/67.9 |
| 3,990,329 | 11/1976 | Laurin | 76/101 R |
| 4,442,939 | 4/1984 | Downing | 206/345 |
| 4,480,356 | 11/1984 | Martin | 24/547 |
| 5,036,973 | 8/1991 | Aida | 206/473 |
| 5,176,765 | 1/1993 | Sunberg | 24/67.9 |

FOREIGN PATENT DOCUMENTS

| | | | |
|---|---|---|---|
| 1489764 | 7/1967 | France | 24/67.9 |

*Primary Examiner*—Victor N. Sakran

*Attorney, Agent, or Firm*—Morse, Altman, Dacey & Benson

[57] ABSTRACT

A sheet-like, integral plastic accessory for a notebook is disclosed featuring at least one paper clip sheet. Each paper clip sheet is formed with a frame as defined by a pair of parallel spaced rims and a pair of outer cross rims. A plurality of ribs extend between the parallel spaced rims in parallel spaced relation to one another. A plurality of paper clip configurations extend from the rims and the ribs. Each paper clip configuration is formed with inner and outer elongated bands joined at one end at a nexus. A pair of curved segments define the nexus at one side thereof, with a constricted portion defining the same at an opposed side. Preferably, a pair of shoulders straddle the constricted portion and a burr connects the constricted portion of the paper clip configuration to the rims and the ribs. Preferably, the nexus is wider and stronger adjacent the curved segments than at the constricted portion, allowing the inner band to bend thereat with respect to the outer band without fracture. Stress points exist at the constricted portion, whereby manipulating one of the pair of shoulders causes severing of the paper clip configuration from the sheet of clips.

24 Claims, 5 Drawing Sheets

SHEET OF CLIPS

BACKGROUND OF THE INVENTION

1. Field of the Invention

The present invention relates generally to a sheet-like integral plastic accessory for use in a loose-leaf notebook having a plurality of loops for reception of a stack of paper clip sheets having a plurality of punched openings in registry with the loops and, more particularly, to a plastic accessory formed between parallel spaced rims and cross rims, having ribs extending between the rims, and featuring a plurality of paper clip configurations extending from the rims and the ribs.

2. The Prior Art

Paper clips have been around for a long time, see the U.S. Pat. No. 649,338 that was granted to G. W. McGill in 1900, entitled "Paper Holding Clip."

In the beginning, paper clips have been formed of metal. More recently, paper clips also have been formed of plastic or similar moldable materials. See the U.S. Pat. Nos. 3,057,028 to K. Lorber; 3,137,934 to R. L. Rhoads; 3,673,641 to K. Lorber; and 5,179,765 to C. B. Sungberg, to mention a few. Such plastic paper clips come in all shapes, sizes and colors and are usually sold in boxes containing a multiplicity of such clips, usually of one particular size and shape, albeit featuring a diversity of colors thereof at times. As far as known however, the prior art is devoid of paper clips made available in a stationery setting. Specifically, the prior art is devoid of a sheet-like, integral plastic accessory for use in and deployment within a loose-leaf notebook, which plastic accessory comprises at least one paper clip sheet containing a plurality of paper clip configurations, each of which becomes an individual paper clip when severed from the plastic accessory.

SUMMARY OF THE INVENTION

It is a principal object of the present invention to overcome the above disadvantages by providing a sheet-like, integral plastic accessory for use in and in combination with a loose-leaf notebook of the kind having a plurality of loops, typically three loops, for reception of punched openings formed in an edge of the accessory. The loose-leaf notebook can contain one or more such sheet-like, integral plastic accessories, in addition to sheets of paper.

More particularly, it is an object of the present invention to provide a sheet-like, integral plastic accessory for use in and in combination with a loose-leaf notebook having, along the spine between a pair of covers, a plurality of loops for reception of punched openings formed in registration along an edge of a stack of paper clip sheets, which plastic accessory comprises a frame having inner and outer rims paralleled spaced to one anther and connected at the top and bottom edges by parallel spaced cross rims. Alternatively the plastic accessory also can be used in a spiral notebook, with the accessory provided with slots to engage the spiral so as to be removably secured therein.

Preferably, the sheet-like, integral plastic accessory is of rectangular frame and is of a size compatible with the sheets of paper or the like that the particular loose-leaf or spiral notebook has been designed for. Preferably, the sheet-like, integral plastic accessory for a loose-leaf notebook includes a plurality of inner ribs that extend between the opposed pairs of rims. A plurality of paper clip configurations extend from the rims and the ribs.

Each of the paper clip configurations includes an outer band and an inner element, an inner junction connection the band to the element and an outer junction connecting the band to one of the cross rims and ribs. Preferably, the inner junction is thicker, wider and stronger than the outer junction. Preferably, the outer junction is constricted such that a stress point exists therebetween and the outer band, whereby bending the clip configuration relative to the outer junction effects a separation of the paper clip configuration from the sheet-like, integral plastic accessory.

Other objects of the present invention will in part be obvious and will in part appear hereinafter.

The invention accordingly comprises the product of the present disclosure, its components, parts and their interrelationship, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENTS

Figure 1:
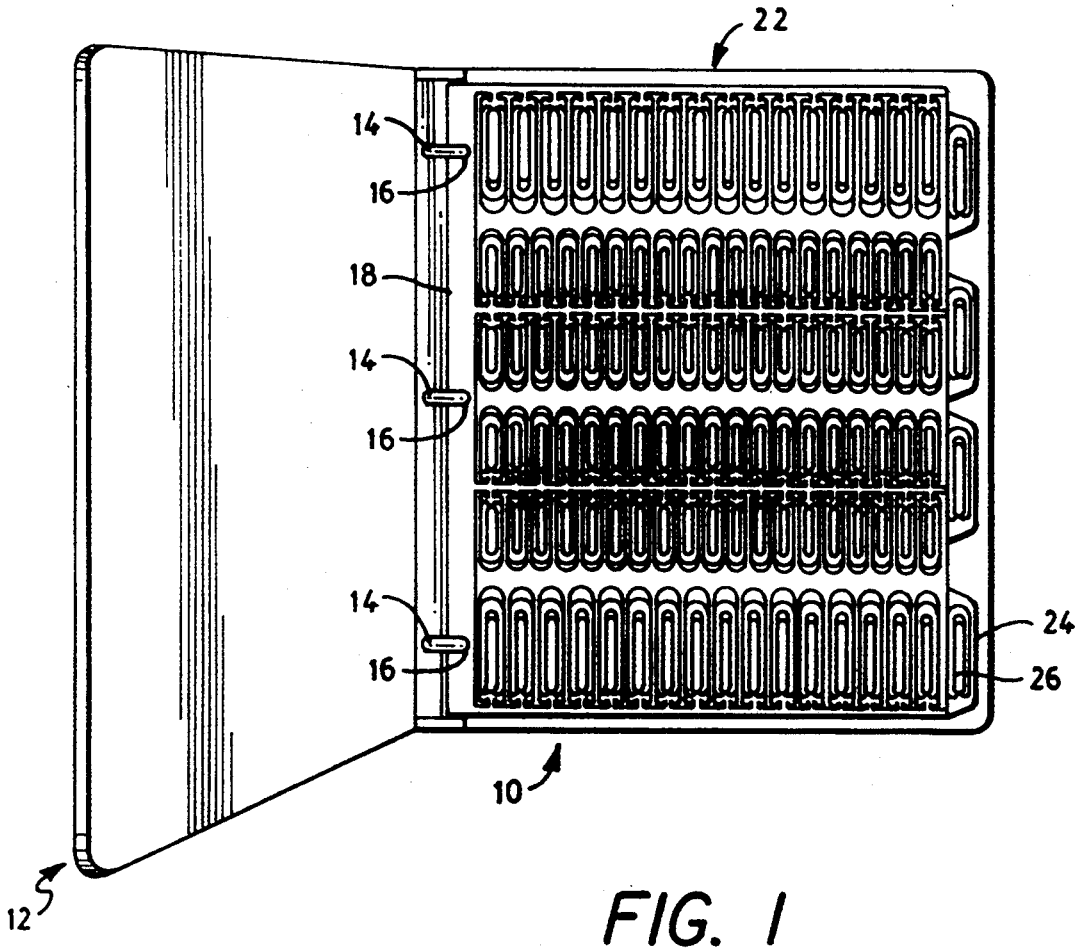
FIG. 1 is a perspective view of a loose-leaf notebook having a plurality of loops for reception of punched openings formed in registration along an edge of a sheet-like, integral plastic accessory according to the invention.
Figure 5:
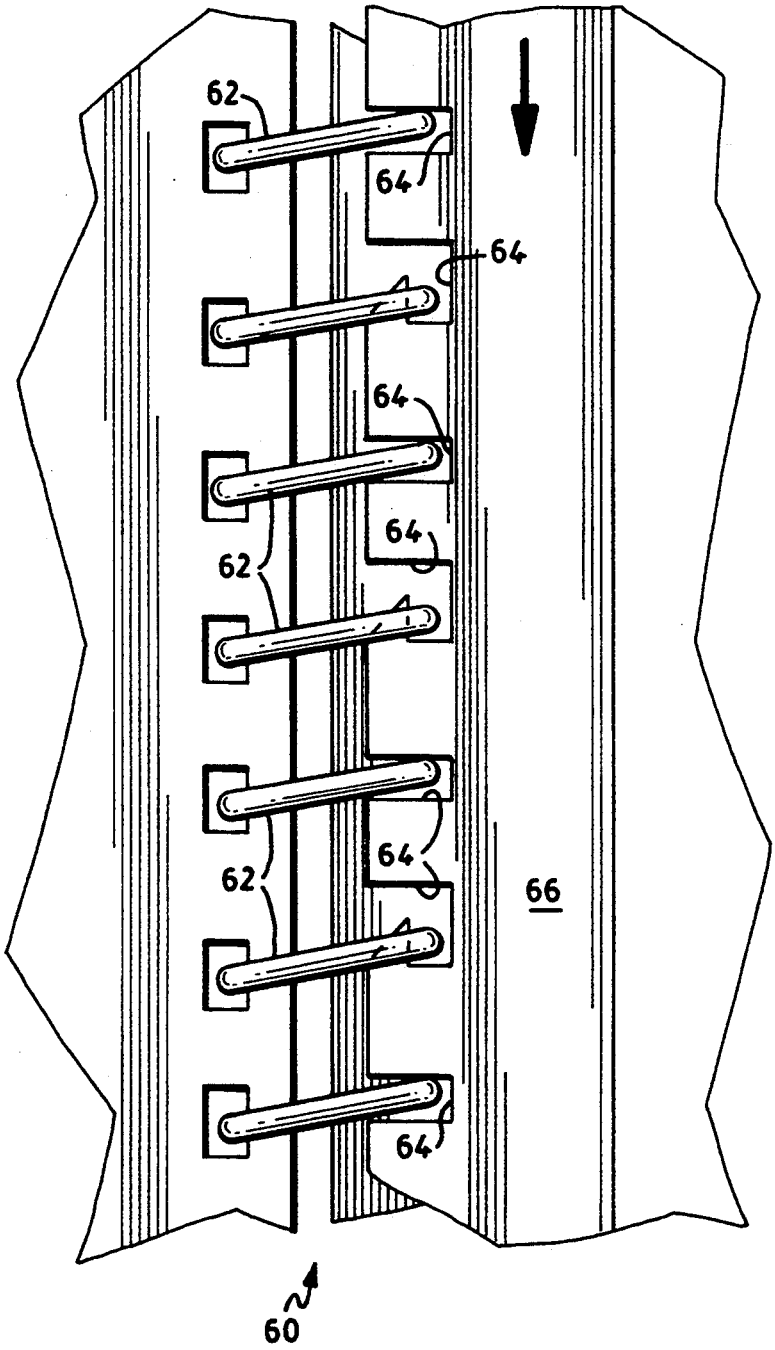
FIG. 5 is a view, on an enlarged scale illustrating a fragmentary portion of a spine of a loose-leaf notebook having a plurality of loops for reception of punched openings formed in registration along an edge of a sheet-like plastic accessory representing another embodiment of the invention.

In general, the present invention relates to a sheet-like integral plastic accessory 10 for use in and in combination with a loose-leaf notebook 12 of the kind having a plurality of loops 14, typically three as shown in FIG. 1, for reception of punched openings 16 formed in registration along an edge 18 of the sheet-like plastic accessory 10. In the alternative, the invention also relates to a sheet-like integral plastic accessory, as illustrated in FIG. 5, for use in and in combination with a loose-leaf or spiral notebook having a spiral binding along its spine for reception of slots 64 formed in an edge thereof in lieu of the punched openings 16. The invention thus makes paper clips available in a stationery setting.

As mentioned, early paper clips were formed of metal. With the advent of plastic technology, paper clips also have been formed of plastic or like moldable materials. Typically, plastic paper clips are sold in boxes containing a multiplicity of like clips, sorted usually according to sizes and shapes and, at times, also according to colors.

Unlike the prior art, the present invention pertains to such a sheet-like plastic accessory 10 for use in and deployment within such a loose-leaf notebook 12, with the sheet-like plastic accessory 10 comprising a plurality of paper clip configurations 20. The loose-leaf notebook 12 preferably contains a stack 22 of such sheet-like plastic accessories 10. Preferably, each sheet-like plastic accessory 10 is provided with an index tab 24, depicting a visual representation 26 of the particular style paper clip configuration 20 that that particular sheet-like plastic accessory 10 contains.

Preferably, the sheet-like plastic accessory 10 is formed of a high impact styrene, preferably by injection molding. The transverse thickness of the sheet-like plastic accessory 10 generally varies within a range from about 0.050 inch to about 0.100 inch, and preferably is between about 0.060 inch to about 0.080 inch.

Each sheet-like, integral plastic accessory 10 comprises a frame 30 formed with an inner rim 32 containing the punched openings 16, (or, in the alternative, the slots 64, see FIG. 5), an outer rim 34 that is parallel spaced from the inner rim 32, and a pair of outer cross-rims 36 and 38 that extend between the inner rim 32 and the outer rim 34. Preferably, the inner rim 32 is wider, hence stronger, than the outer rim 34, so as to accommodate the punched openings 16 (or, the slots 60) and thus securely to contain the sheet-like accessory 10 fastened about the loops 14 (or to the spiral binding) of the loose-leaf notebook 12.

A plurality of inner ribs 40 extend between the rims 32 and 34 and in parallel spaced relation to the pair of outer cross rims 36 and 38. And a plurality of paper clip configurations 42 in turn extend from the rims 36, 38 and the ribs 40.

Figure 2:
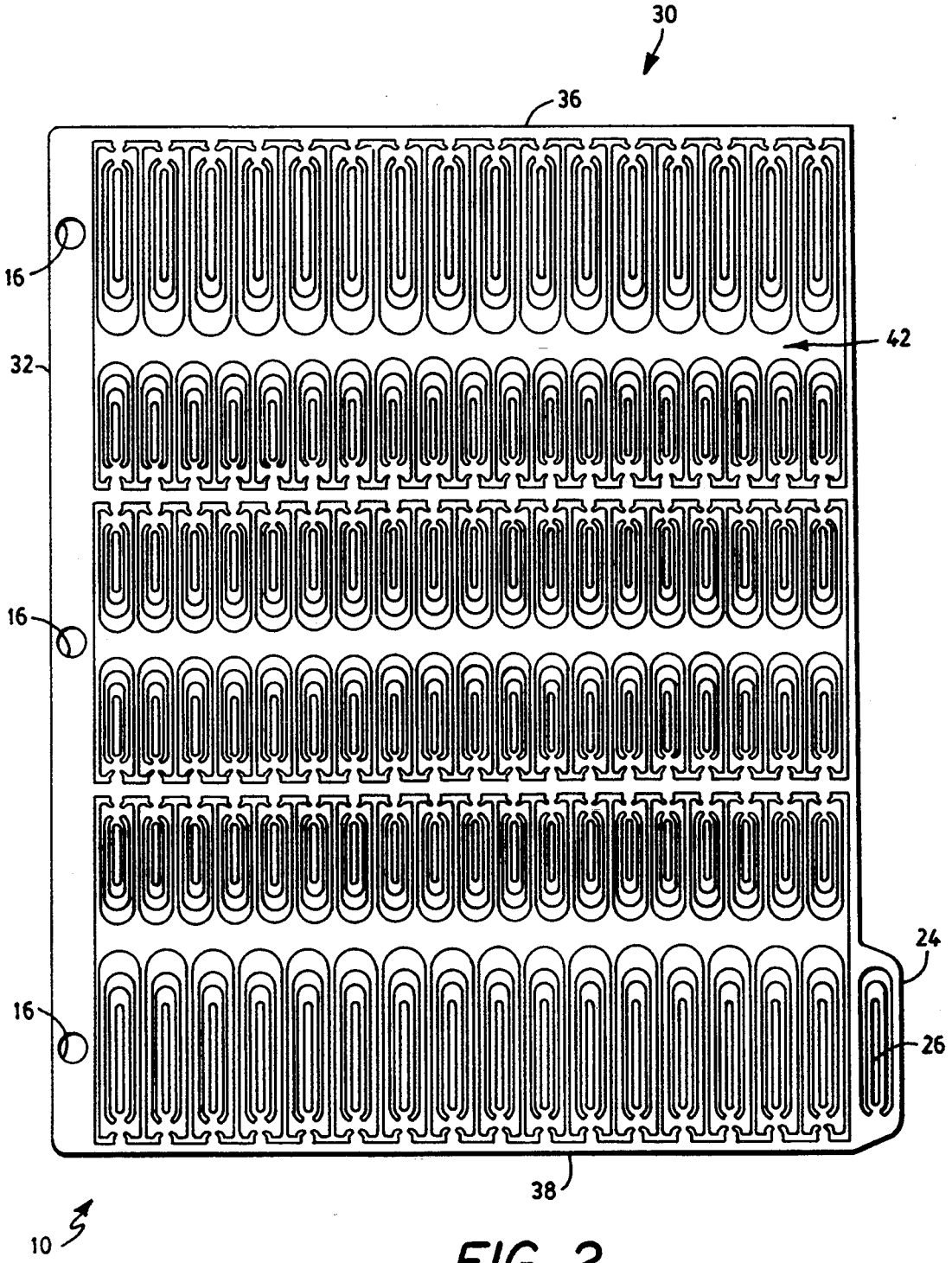
FIG. 2 is a plan view, on an enlarged scale, of the sheet-like, integral plastic accessory of FIG. 1.

As may be best observed in FIG. 2, the paper clip configurations 42 formed adjacent the rims 36 and 38 are all of the same size and shape but are larger than the paper clip configurations 42 formed adjacent the ribs 40, 40 in the central part of the sheet-like accessory 10. Of course, the relative sizes and shapes of these configurations is a matter of choice and can easily be varied by varying the molds, not shown, within which the particular sheet-like integral plastic accessory 10 is formed, preferably by injection molding. Other molding techniques also can be employed, as known.

Figure 3:
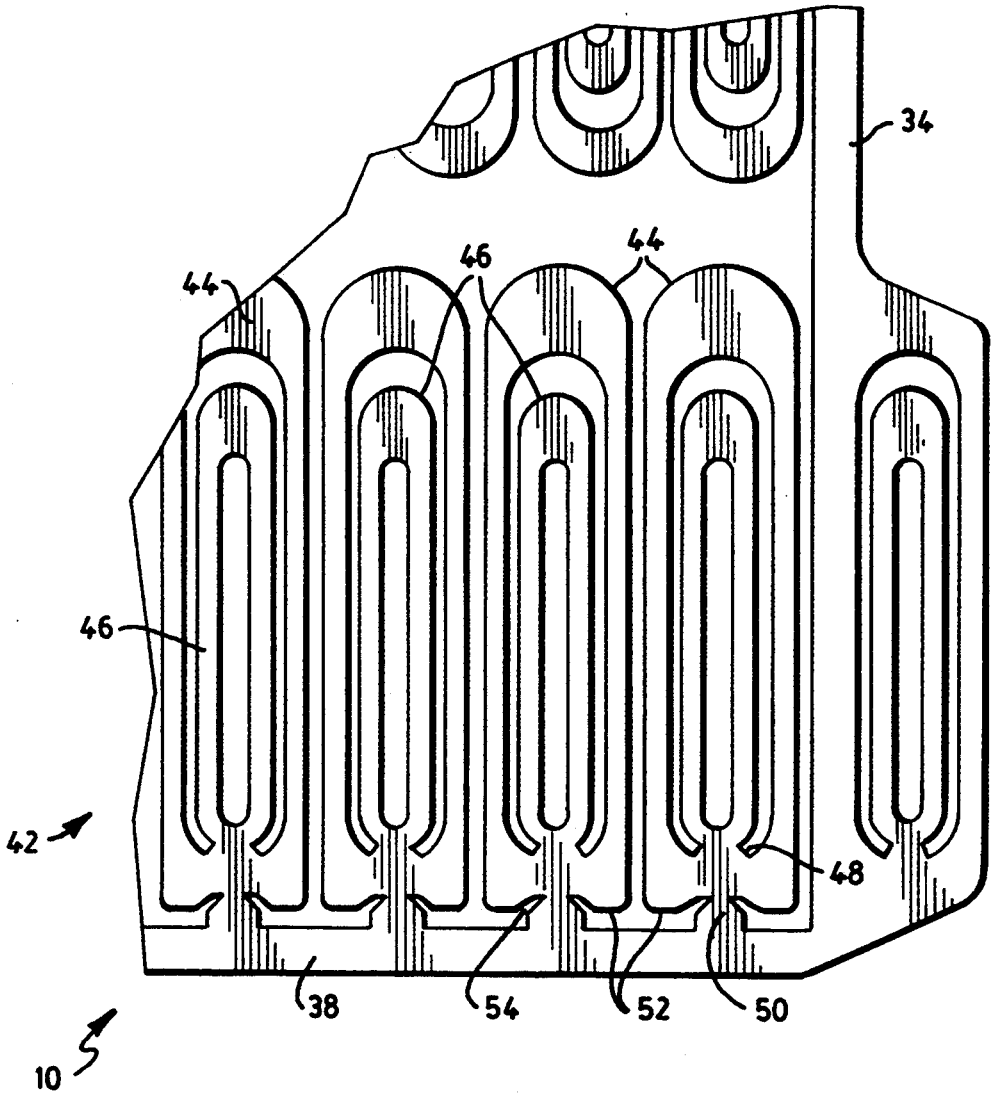
FIG. 3 is a representative section of the sheet-like, integral plastic accessory of FIG. 2 but on a much enlarged scale.
Figure 4:
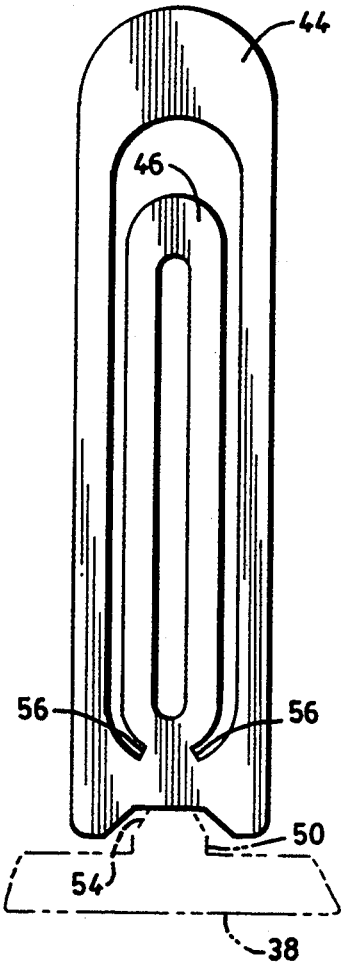
FIG. 4 is a plan view of a representative segment of a still further enlarged scale; the sheet-like, integral plastic accessory of FIG. 3 but on a still further enlarged scale.

As may be best observed in FIGS. 3 and 4, each of the paper clip configurations 42 comprises an outer elongated band 44 and an inner elongated element 46, joined at one end by an inner junction 48. An outer junction 50 extends between the outer elongated band 44 and the rim 38 or the rib 40, as the case may be. The outer elongated band 44 preferably is indented in the vicinity of the outer junction 50 to provide shoulders 52, 52, with the outer junction 50 being sharply constricted, as at 54, at the elongated band 44 and in between the shoulders 52, 52.

As may be observed, the inner junction 48 is both thicker and wider, hence stronger, than the outer junction 50 is at the constricted portion 54. Consequently, stress points exist between the outer junction 50 and the elongated band 44. Manipulating one of the clip configurations 42 in the vicinity of the outer junction 50, such as by bending at the shoulders 52, 52 thereof, causes severing, at the constricted potion 54, of that particular clip configuration 42 from the sheet-like accessory 10, of which until then, it has been an integral part.

The inner junction 48 serves, as mentioned, as a nexus between the outer elongated band 44 and the inner elongated element 46, itself also formed as a band. The width of this nexus is defined by a pair of curved slots 56, 56, separating the inner from the outer band. The outer junction 50, formed as a burr during the injection molding operation, connects to the outer band 44, at the sharply constricted portion 54, to facilitate the severing of the particular clip configuration thereat from the sheet-like integral plastic accessory 10. The inner junction 48 facilitates, in turn, both the injection forming of these plurality of paper clip configurations 42 and, after severing from the accessory 10, the operative use of the now severed plastic paper clip by allowing for the bending of the outer band 44 with respect to the inner elongated band or element 46 so as to retain two or more sheets of paper therein, as paper clips are wont to do. And, these severed paper clips from the sheet-like, integral plastic accessory 10 do exhibit this resilience at the nexus 48 without fracture thereat.

The Embodiment of FIG. 5

In FIG. 5, there is illustrated, on an enlarged scale, a fragment of a spine 60 of a loose-leaf notebook having a plurality of loops 62 for reception of punched openings herein shaped as slot 64 formed in registration along an edge 66 of a sheet-like plastic accessory 68. This sheet-like plastic accessory 68 is, in all other respects, just like the sheet-like plastic accessory 10 shown in and described with reference to FIGS. 1–4.

Figure 6:
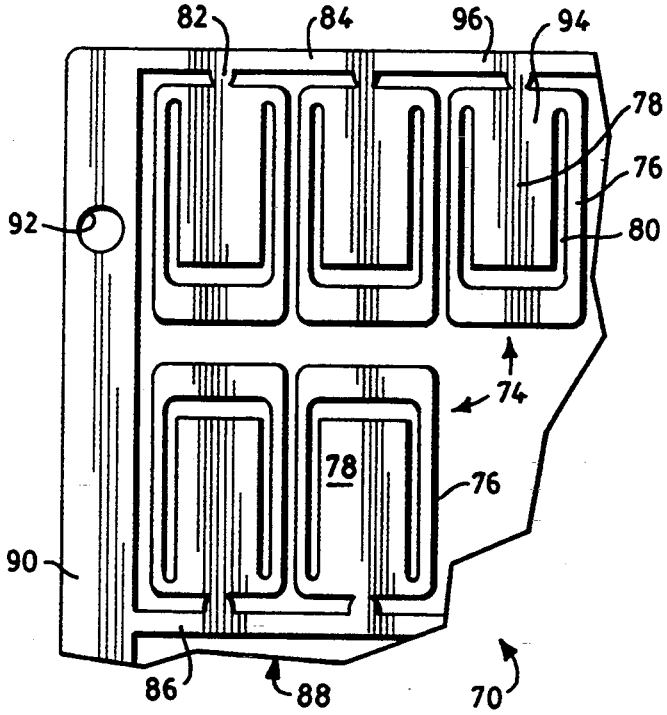
FIG. 6 is a view similar to FIG. 3 but showing a further embodiment of a sheet-like, integral plastic accessory according to the invention.
Figure 7:
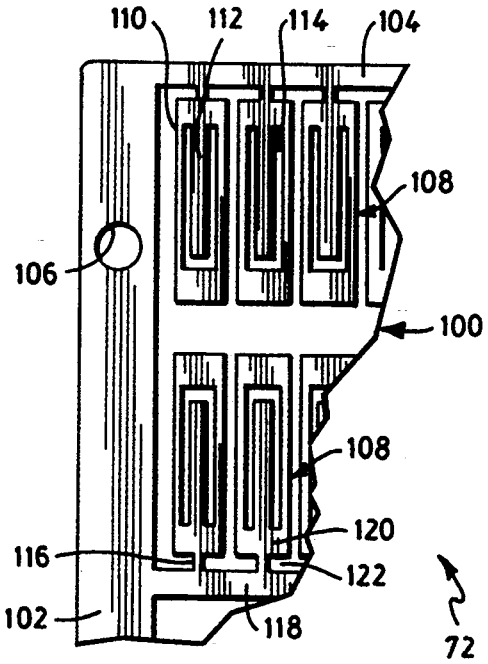
FIG. 7 is a view similar to FIG. 6 but showing a still further embodiment of a sheet-like, integral plastic accessory according to the invention.

In the alternative, the sheet-like plastic accessory 68 also can be formed as illustrated in FIGS. 6 and 7.

The Embodiments of FIGS. 6 and 7

In FIGS. 6 and 7, there are illustrated fragmentary sections 70 and 72 respectively of further embodiments of a sheet-like, integral plastic accessory according to the invention. Each of these fragmentary sections 70 and 72 is similar to the sheet-like plastic accessory 10 of FIG. 2 excepting the shapes and sizes of the particular paper clip configurations 42 illustrated in FIGS. 2–4.

In FIG. 6, paper clip configurations 74 are illustrated. Each of these clip configurations 74 is of rectangular shape, comprising an outer section 76 and an inner section 78, separated by a U-shaped space 80. A burr 82, formed during injection molding, once again physically connects each one of the paper clip configurations to a rim 84 or a rib 86 of a frame 88 in a fashion similar to that shown in and described with reference to FIG. 2. Frame 88 also is formed with opposed parallel spaced rims, with only an inner rim 90 thereof being illustrated in FIG. 6. Further, rim 90 can be provided with punched holes 92, as shown or, in the alternative, with a series of punched openings 64, as in FIG. 5. Again, the paper clip configuration 74 is formed with an inner junction 94 as well as with an outer junction 96, defining a sharp constriction between the burr 82 and the inner junction 94. Again, the inner junction 94 is much thicker and wider, hence stronger, than the outer junction 96 is at this constricted portion between the burr 82 and the paper clip configuration 74. As a consequence, stress points again exist at this constricted portion. Manipulating one of these clip configurations in the vicinity of the outer junction 96 once again causes severing of that particular clip configuration 74 from the sheet-like plastic accessory.

In FIG. 7, the fragmentary section 72 of a sheet-like plastic accessory according to the invention also comprises a frame 100 having rims and cross rims, with but an inner rim 102 and one cross rim 104 being illustrated. Again, the inner rim 102 can be provided with punched holes 106 or with punched openings 64 illustrated in FIG. 5. Paper clip configurations 108 are similar to those 74 illustrated in FIG. 6, albeit being narrower.

Each of these paper clip configurations 108 comprises an outer segment 110, an inner segment 112, separated by a U-shaped space 114. A burr 116 connects the clip configurations 108 either to the rim 104 or to a rib 118. An inner junction 120, again wider and stronger, connects with an outer junction 122 at a constricted portion of the burr 116. Consequently, stress points exist between the outer junction 122 and the burr 116. Manipulating one paper clip configuration 108 again effects the severing thereof from the sheet-like plastic accessory whose fragmentary section 72 is illustrated in FIG. 7.

Thus it has been shown and described a sheet-like, integral plastic accessories 10, 68, 70 and 72 for use in combination with a loose-leaf notebook 12, which accessories 10, 68, 70 and 72 satisfy the objects and advantages set forth above.

Since certain changes may be made in the present disclosure without departing from the scope of the present invention, it is intended that all matter described in the foregoing specification or shown in the accompanying drawings, be interpreted in an illustrative and not limiting sense.

What is claimed is:

1. A sheet of clips for use in combination with a notebook having a plurality of loops, said sheet comprising:

(a) a sheet of paper clips having a plurality of openings in registry with said loops;

(b) said sheet framed between parallel spaced rims and cross rims;

(c) a plurality of ribs parallel spaced to said cross rims and extending between said parallel spaced rims; and (d) a plurality of paper clip configurations extending from said cross rims and said ribs;

(e) each of said paper clip configurations including an outer band and an inner element, an inner junction connecting said band to said element, and an outer junction connecting said band to one of said cross rims and said ribs;

(f) said outer junction being constricted, whereby a stress point exist between said outer junction and said band such that bending said clip configuration with respect to said outer junction effects separation thereof from said sheet.

2. The sheet of clips of claim 1 wherein said inner junction is stronger than said outer junction, facilitating the use of said severed clip configuration as a paper clip.

3. The sheet of clips of claim 1 wherein said sheet is formed of plastic with a transverse thickness ranging from about 0.050 inch to about 0.100 inch.

4. The sheet of clips of claim 3 wherein said plastic is a high impact styrene.

5. The sheet of clips of claim 1 wherein said inner junction is defined between opposed curved segments separating said outer band from said inner element at said inner junction.

6. The sheet of clips of claim 1 wherein said sheet is further provided with an index tab depicting said paper clip configurations.

7. The sheet of clips of claim 1 wherein said sheet is rectangular in outer configuration.

8. The sheet of clips of claim 1 wherein said plurality of openings are formed in one of said parallel spaced rims, said one being wider than the other of said parallel spaced rims.

9. The sheet of clips 1 wherein said cross rims connect said parallel spaced rims at the ends thereof.

10. In combination, a sheet of clips for mounting in a loose-leaf notebook having a plurality of loops for reception of openings formed in an edge of said sheet of clips, said sheet of clips containing at lease one paper clip configuration formed integral of said sheet, said paper clip configuration comprising:

(a) inner and outer elongated bands joined at one end at a nexus;

(b) said nexus being stronger at said one end than at a constricted portion thereof;

(c) a pair of shoulders straddling said constricted portion; and (d) a burr connecting said constricted portion to said sheet;

(e) said paper clip configuration being formed in the plane of said sheet of clips;

(f) wherein a stress point exists at said constricted portion, whereby manipulating one of said pair of shoulders causes severing of said paper clipconfiguration from said sheet of clips.

11. The combination of claim 10 wherein said sheet of clips is formed by injection forming.

12. In combination a sheet of clips for mounting in a loose-leaf notebook having a plurality of loops for reception of openings formed in an edge of said sheet of clips, said sheet of clips containing at least one paper clip configuration formed integral of said sheet, said paper clip configuration comprising:

(a) inner and outer elongated bands joined at one end at a nexus;

(b) said nexus being stronger at said one end than at a constricted portion thereof;

(c) a pair of shoulders straddling said constricted portion; and (d) a burr connecting said constricted portion to said sheet;

(e) said sheet of clips formed of a high impact styrene, and provided with an index tab featuring said paper clip configuration.

13. In combination a sheet of clips for mounting in a loose-leaf notebook having a plurality of loops for reception of openings formed in an edge of said sheet of clips, said sheet of clips containing at least one paper clip configuration formed integral of said sheet, said paper clip configuration comprising:

(a) inner and outer elongated bands joined at one end at a nexus;

(b) said nexus being stronger at said one end than at a constricted portion thereof;

(c) a pair of shoulders straddling said constricted portion; and (d) a burr connecting said constricted portion to said sheet;

(e) wherein said inner and outer elongated bands define a paper clip configuration that is at least twice as long along its axial length than its width in a direction normal to said axial length;

(f) wherein said nexus allows for flexing in and out of plane and between said inner and outer elongated bands without fracture thereof at said nexus.

14. A sheet-like, integral plastic accessory for a notebook having, along the spine between a pair of covers, a plurality of loops for reception of openings in registration along an edge of a stack of rectangular paper clip sheets, said plastic accessory comprising:

(a) a frame having an inner rim with openings for engagement with said loops, an outer rim that is spaced from and in parallel with said inner rim, and a pair of outer cross rims that extend between said inner rim and said outer rim;

(b) a plurality of inner ribs that extend between opposed pairs of said rims; and (c) a plurality of paper clip configurations extending from said rims and said ribs;

(d) each of said paper clip configurations including an outer elongated band and an inner elongated element, an inner junction extending between said inner elongated element and said outer elongated band, and an outer junction extending between said outer elongated band and one of said rims and said ribs;

(e) said elongated band, in the vicinity of said outer junction being indented to provide shoulders; said outer junction being sharply constricted at said elongated band between said shoulders;

(f) whereby stress points exist between said outer junction and said elongated band, by which bending of said clip configuration with respect to said outer junction causes severing thereof from said sheet-like accessory.

15. The sheet-like, integral plastic accessory of claim 14 wherein said plastic is a high impact styrene, and wherein said plastic accessory is formed by injection forming with a thickness ranging from about 0.050 inch to about 0.100 inch.

16. The sheet-like, integral plastic accessory of claim 14 wherein said inner junction is yieldably flexible to allow for the flexing of said inner elongated element in and out of the plane as defined by said outer elongated band without rupture at said inner junction.

17. The sheet-like, integral plastic accessory of claim 14 wherein said plurality of paper clip configurations are arranged in parallel rows in said frame between said inner and outer rim thereof, and wherein said paper clip configurations in each said parallel rows are identical in shape but are different in size as between said parallel rows.

18. A sheet of clips for use in combination with a notebook having a plurality of loops, said sheet comprising:

(a) a sheet of paper clips having a plurality of openings in registry with said loops:

(b) said sheet framed between two pairs of orthogonal rims;

(c) a plurality of ribs parallel spaced to said pairs of orthogonal rims and extending there between; and (d) a plurality of paper clip configurations extending from said pairs of orthogonal rims and said ribs;

(e) each of said paper clip configurations including an outer band and an inner element, an inner junction connecting said band to said element, and an outer junction connecting said band to one of said pairs of orthogonal rims and said ribs;

(f) said outer junction being constricted, whereby a stress point exists between said outer junction and said band such that bending said clip configuration with respect to said outer junction effects separation thereof from said sheet.

19. A sheet-like plastic accessory for a notebook having, along a spine between a pair of covers, a plurality of aligned loops for reception of aligned openings in registration along an edge of a stack of thin sheets, said plastic accessory comprising:

(a) a frame including inner, outer and connecting portions;

(b) a plurality of clip configurations, each clip configuration including an outer element, an inner element and a nexus therebetween;

(c) one of said portions of said frame having aligned openings for reception of said aligned loops;

(d) a plurality of junctions, of which each junction connects said nexus to one of said portions of said frame;

(e) said nexus resiliently tending to maintain said inner element and said outer element in predetermined relation;

(f) said inner element and said outer element thereby being adapted to grip thin sheets therebetween;

(g) said frame, said clips configurations, and said junctions being integral;

(h) said junction being constricted dimensionally so as to be rupturable when said clip configuration is bent with respect to said frame.

20. The sheet-like plastic accessory of claim 19 wherein said inner element is stronger than said outer element, facilitating the use of said rupturable clip configuration as a paper clip.

21. The sheet-like plastic accessory of claim 20 wherein said plastic is a high impact styrene.

22. The sheet-like plastic accessory claim 19 wherein said frame is further provided with an index tab depicting said clip configurations.

23. The sheet-like plastic accessory of claim 21 wherein said plastic is a high impact styrene, and wherein said plastic accessory is formed by injection forming with a thickness ranging from about 0.050 inch to about 0.100 inch.

24. The sheet-like plastic accessory of claim 19 wherein said plurality of clip configurations are arranged in parallel rows in said frame, and wherein said clip configurations in each said parallel rows are identical in shape but are different in size as between said parallel rows.

* * * * *